US006027395A

United States Patent [19]

Strom

[11] Patent Number: 6,027,395

[45] Date of Patent: Feb. 22, 2000

[54] TOUCH-RESPONSIVE SELF-POWERED CARRIER AND PLUSH FIGURE

[75] Inventor: David Strom, Redondo Beach, Calif.

[73] Assignee: Mattel, Inc., El Segundo, Calif.

[21] Appl. No.: 09/132,125

[22] Filed: Aug. 10, 1998

[51] Int. Cl.[7] ..... A63H 13/00; A63H 11/02; A63H 7/00; A63H 17/00; A63H 29/00

[52] U.S. Cl. ..... 446/274; 446/3; 446/269; 446/280; 446/436; 446/457

[58] Field of Search ..... 446/3, 269, 272, 446/273, 274, 275, 279, 280, 288, 436, 441, 454, 457

[56] References Cited

U.S. PATENT DOCUMENTS

| | | | |
|---|---|---|---|
| 2,656,645 | 10/1953 | Goldfarb . | |
| 3,359,680 | 12/1967 | Lindsay | 446/272 X |
| 3,553,885 | 1/1971 | Tazaki | 446/279 |
| 3,708,913 | 1/1973 | Terzian et al. | 446/440 |
| 3,772,824 | 11/1973 | Terzian et al. . | |
| 4,568,307 | 2/1986 | Gabler et al. . | |
| 4,597,744 | 7/1986 | Rehkemper et al. . | |
| 4,693,697 | 9/1987 | Pagano . | |
| 4,820,236 | 4/1989 | Berliner et al. . | |
| 4,836,819 | 6/1989 | Oishi et al. . | |
| 4,867,726 | 9/1989 | Fujimaki . | |
| 4,983,890 | 1/1991 | Satoh et al. . | |
| 5,003,714 | 4/1991 | Satoh et al. . | |
| 5,100,362 | 3/1992 | Fogarty et al. . | |
| 5,138,535 | 8/1992 | Aragon, Jr. . | |
| 5,152,708 | 10/1992 | Claugus et al. | 446/3 X |
| 5,154,658 | 10/1992 | Marcus . | |
| 5,267,886 | 12/1993 | Wood et al. . | |
| 5,372,534 | 12/1994 | Levy et al. | 446/469 X |
| 5,657,721 | 8/1997 | Mayfield et al. . | |
| 5,697,829 | 12/1997 | Chainani et al. | 446/436 |

FOREIGN PATENT DOCUMENTS

| | | | |
|---|---|---|---|
| 971362 | 7/1975 | Canada | 446/272 |
| 474855 | 11/1937 | United Kingdom | 446/279 |
| 2224662 | 5/1990 | United Kingdom | 446/279 |

*Primary Examiner*—D Neal Muir
*Attorney, Agent, or Firm*—Roy A. Ekstrand

[57] ABSTRACT

A self-powered carrier includes a seat within a cockpit and a quartet of rolling wheels each supported by downwardly extending wheel supports. A battery pack and motor drive supported within the carrier are operative in response to a motion sensing switch to activate the drive motor and produce rotational power which is coupled to the front two supporting wheels to move the carrier forward. The seat is pivotally supported within the cockpit and is configured to receive a plush figure straddling the seat and having its legs secured by fabric attachment pads. A timer within the battery power circuit interrupts operation of the motor following each activation and a predetermined time interval.

11 Claims, 4 Drawing Sheets

TOUCH-RESPONSIVE SELF-POWERED CARRIER AND PLUSH FIGURE

FIELD OF THE INVENTION

This invention relates generally to toys fabricated for infants and very young children and particularly to such toys in the form of a wheeled carrier or vehicle.

BACKGROUND OF THE INVENTION

Toys which are designed and constructed for infants and very young children are well known and pervasive in the art. Such toys have included so-called "plush" figures having generally soft resilient bodies covered by a flexible skin or coat and have often replicated humans, human infants or animals of a friendly appealing nature. Such toys for infants and young children have also been provided having musical apparatus for interesting the child user as well as talking apparatus for interacting with the child user. Still other forms of such toys for infants and young children have included those having motorized internal battery-power apparatus which is able to provide movement or articulation within the figure such as crawling, walking and mouth movement to further interest the child.

A popular toy for use by infants and very young children is known in the art as "push-pull" toys which have been provided in great variety and may generally be described as having a housing often replicating an animal figure or the like together with a plurality of rolling wheels. In many such toys, at least of one of the rolling wheels is in effect a drive wheel coupled to an internal mechanism within the toy housing. The result of rolling the push-pull toy across a floor surface is the rotation of the drive wheel and a transmission of energy therefrom to other active objects such as balls or the like which are agitated and so on to produce a pleasing appearance. Such toys often utilize sound in combination with the amusing action of the objects. An earlier predecessor of such toys are known generally in the art as "walker" and have similar housings supported by rolling wheels and further including a raised handle portion for the child to grasp as the young child walks with the partial support of the rolling walker. Still other toys for infants and young children have provided a carriage which supports a toy figure. In most instances, the toy figure is a plush configured to be friendly and appealing to an infant of young child.

U.S. Pat. No. 2,656,645 issued to Goldfarb sets forth a ROCKABLE WHEELED FIGURE TOY having a generally planar base supported by rolling wheels secured in an off-center relationship to the base. The base further includes a pair of side portions having a gap therebetween on each side of the base. The space between the generally planar members receives a toy figure which is pivotally secure between the two members and which is rocked back and forth as the combination rolls across the eccentric wheels.

U.S. Pat. No. 4,693,697 issued to Pagano sets forth a PUSH-PULL TOY having a hollow body simulating the body of an animal and formed with a transparent or semi-transparent window. A plurality of wheels support the body which in turn supports a pivotally secured head. A plurality of pop-ejection marbles or balls are connected within the body and visible through the window. As the toy is rolled across a floor surface, the wheels rotate to provide energy which is coupled to the pop-ejection mechanism and to a cam which causes the toy head to nod up and down.

U.S. Pat. No. 4,836,819 issued to Oishi, et al. sets forth a SKATEBOARDING TOY having a skateboard supporting a toy figure. One wheel within the plurality of wheels supporting the skateboard is used as a drive wheel wherein a mechanism couples the energy of rotation of the wheel to a steerable front axle assembly causing the travel path of the skateboard to be multiply curved and randomized.

U.S. Pat. No. 5,100,362 issued to Fogarty, et al. sets forth a PROPELLABLE ARTICULATING ANIMAL TOY having a hand controlled staff defining an upper grip and a lower end together with a toy figure having rolling wheels concealed on the underside thereof. The rolling wheels actuate various articulated elements in the figure's body to provide an action as the toy figure is rolled about.

U.S. Pat. No. 5,154,648 issued to Marcus sets forth a WALKER TOY having sound and light modules therein. The walker unit is operated by a toddler age child for stabilizing the child during the walking exercise. The sound and light modules are responsive to movement of the walker toy for producing predetermined light and sound.

U.S. Pat. No. 5,267,886 issued to Wood, et al. sets forth a MULTIPLE ACTION PLUSH TOY having a toy body generally resembling a bulldog and having a front leg and paw receiving an supporting a flashlight. A police flashing light is supported on the top of the figure and responds to certain touching of the toy figure.

U.S. Pat. No. 5,003,714 issued to Satoh, et al. sets forth a FIGURE MOVING ARTICLE having a deformible cylindrical body supporting an internal drive mechanism together with an offset drive set coupled to the top of the cylindrical body. As the shaft is driven, an oscillatory motion is provided in the upper portion of the body which is resisted by the lower portion of the body causing the body to undergo various deformations.

U.S. Pat. No. 4,867,726 issued to Fujimaki sets forth a ANIMAL TOYS capable of electrically producing and/or body movements which are switched on and off by a pair of spaced electrical contacts disposed on a bottom surface of the animal toy. When the toy is placed in an individual's hand, the two contacts are bridged and electrical circuit completed for activating sound and/or movement.

U.S. Pat. No. 4,597,744 issued to Rehkemper, et al. sets forth a SELF-PROPELLED TOY having a tricycle wheel support which includes an articulated support for the forwardmost single wheel thereof. Battery power means are operative to drive the vehicle and to articulate the front wheel support.

U.S. Pat. No. 3,772,824 issued to Terzian, et al. set forth a TOY VEHICLE APPARATUS capable of varying operating characteristics. The vehicle is particularly adapted to do "trick" type operation.

U.S. Pat. No. 5,657,721 issued to Mayfield, et al. sets forth a CAT EXERCISE TOY having a base supporting an upwardly extending flexible shaft supporting a target object at the end thereof which is configured to attract a cat. Movement apparatus housed within the base cause the shaft to be moved and flexed in order to interest a cat.

U.S. Pat. No. 4,983,890 issued to Satoh, et al. sets forth a ROTATING DRIVE DEVICE having a base supporting a pair of upwardly extending shafts having offset portions. Decorative covering of the shaft supports a plurality of elements such as leaves and flowers. As the drive unit in the base rotates the shafts, an undulating action is provided in the flowers.

U.S. Pat. No. 4,568,307 issued to Gabler, et al. sets forth a PUSH TOY VEHICLE WITH OPERABLE MOUTH having a toy vehicle supported by a plurality of rolling wheels together with a motion converting apparatus. The body further supports a pivotal mouth coupled to at least one of the wheels by the motion converting apparatus to cause the mouth to open and close as the toy is rolled.

U.S. Pat. No. 4,820,236 issued to Berliner, et al. sets forth a DOLL WITH SENSING SWITCH having a flexible sensor supported within a plush object. The sensor is coupled to responsive apparatus and is triggered by the deformation of the plush toy region around the sensor as a child pushes or squeezes it.

U.S. Pat. No. 5,138,535 issued to Aragon, Jr. sets forth an INFANT TOY HAVING IMPACT-RESPONSIVE LIGHT GENERATING MEANS utilizing a light transparent shell, a light source in the interior of the shell, an impact or motion sensing member within the shell and a source of battery power to energize the light production when the objects sustains an impact.

While the foregoing described prior art devices have improved the art and have in some instances enjoyed commercial success, there remains nonetheless a continuing need in the art for evermore improved interesting and entertaining toys for infants and very young children.

SUMMARY OF THE INVENTION

Accordingly, it is a general object of the present invention to provide an improved toy for play by infants and very young children. It is a more particular object of the present invention to provide such an improved toy which induces physical activity in the child user by motivating the infant or very young child to move about and engage in physical activity.

In accordance with the present invention, there is provided in combination with a toy figure and a self-propelled toy figure carrier, the combination comprising: a toy figure having a body and a pair of legs; a carrier having a body defining a cockpit and a plurality of supporting wheels; a seat pivotably supported within the cockpit for receiving the toy figure; drive means within the carrier coupled to at least one of the wheels for propelling the carrier; a motion sensor initiating activation of the drive means in response to movement; and timing means, responsive to the motion sensor, for timing an operational interval for the drive means and thereafter interrupting drive means operation.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
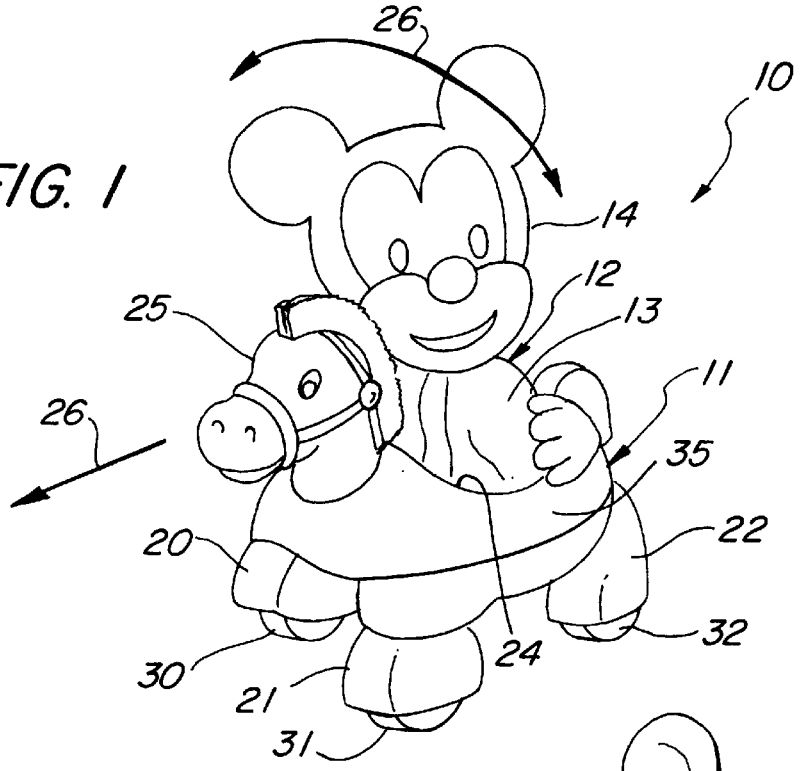
FIG. 1 sets forth a front perspective view of a touch-responsive self-powered carrier and plush figure constructed in accordance with the present invention.

FIG. 1 sets forth a perspective view of a touch-responsive self-powered carrier and plush figure constructed in accordance with the present invention and generally referenced by numeral 10. Toy 10 includes a carrier 11 supporting a plush FIG. 12. Plush FIG. 12 is fabricated in accordance with conventional fabrication techniques for plush toy figures and, as a result, includes a body 13 supporting a head 14 together with legs 16 and 17 (seen in FIG. 2). With the exception of the attachment pads shown in FIG. 2 and referenced by numbers 40, 41 and 42, plush FIG. 12 may be fabricated entirely in accordance with conventional fabrication techniques.

Figure 4:
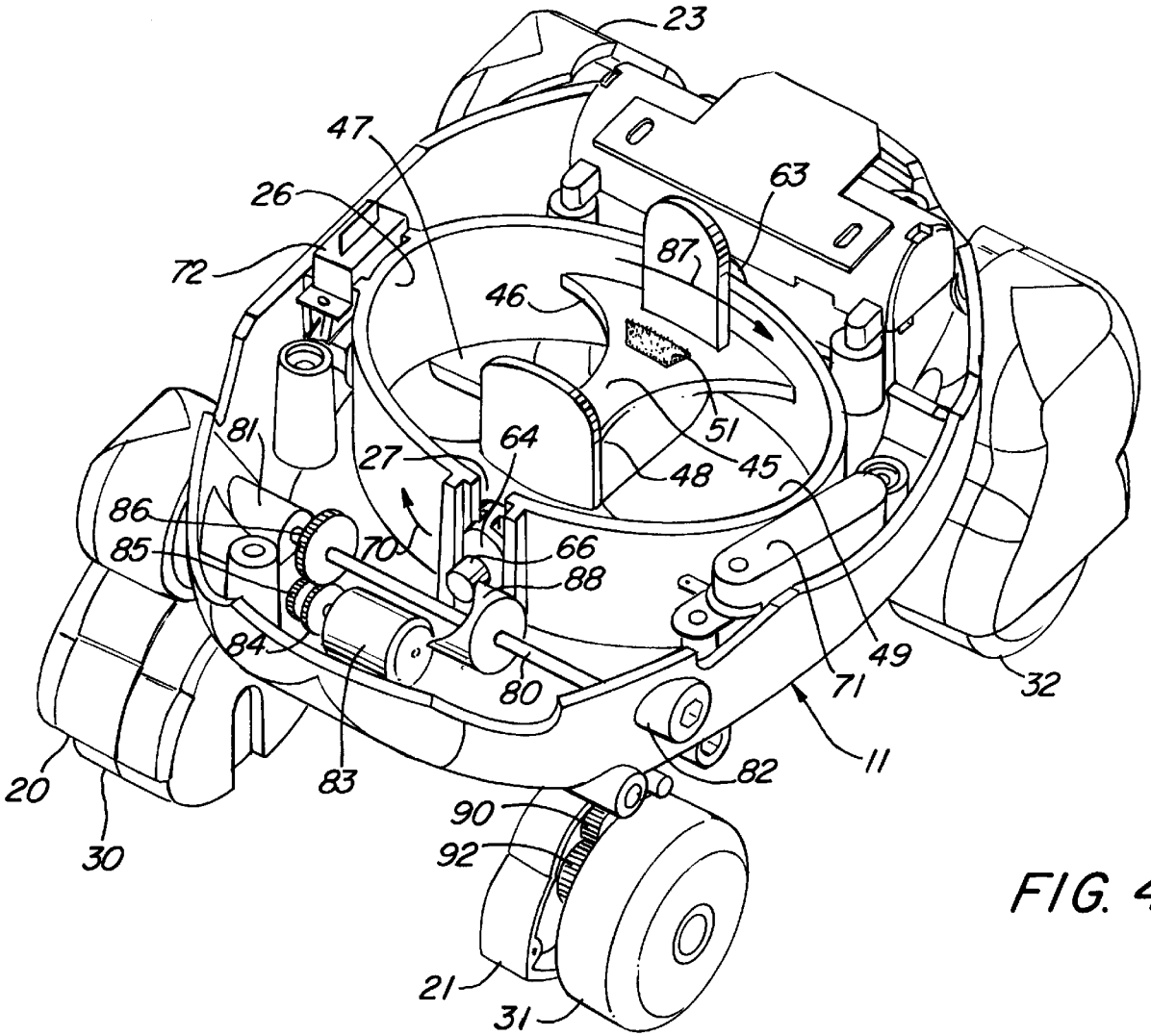
FIG. 4 sets forth a perspective view of the lower portion of the present invention carrier.
Figure 5:
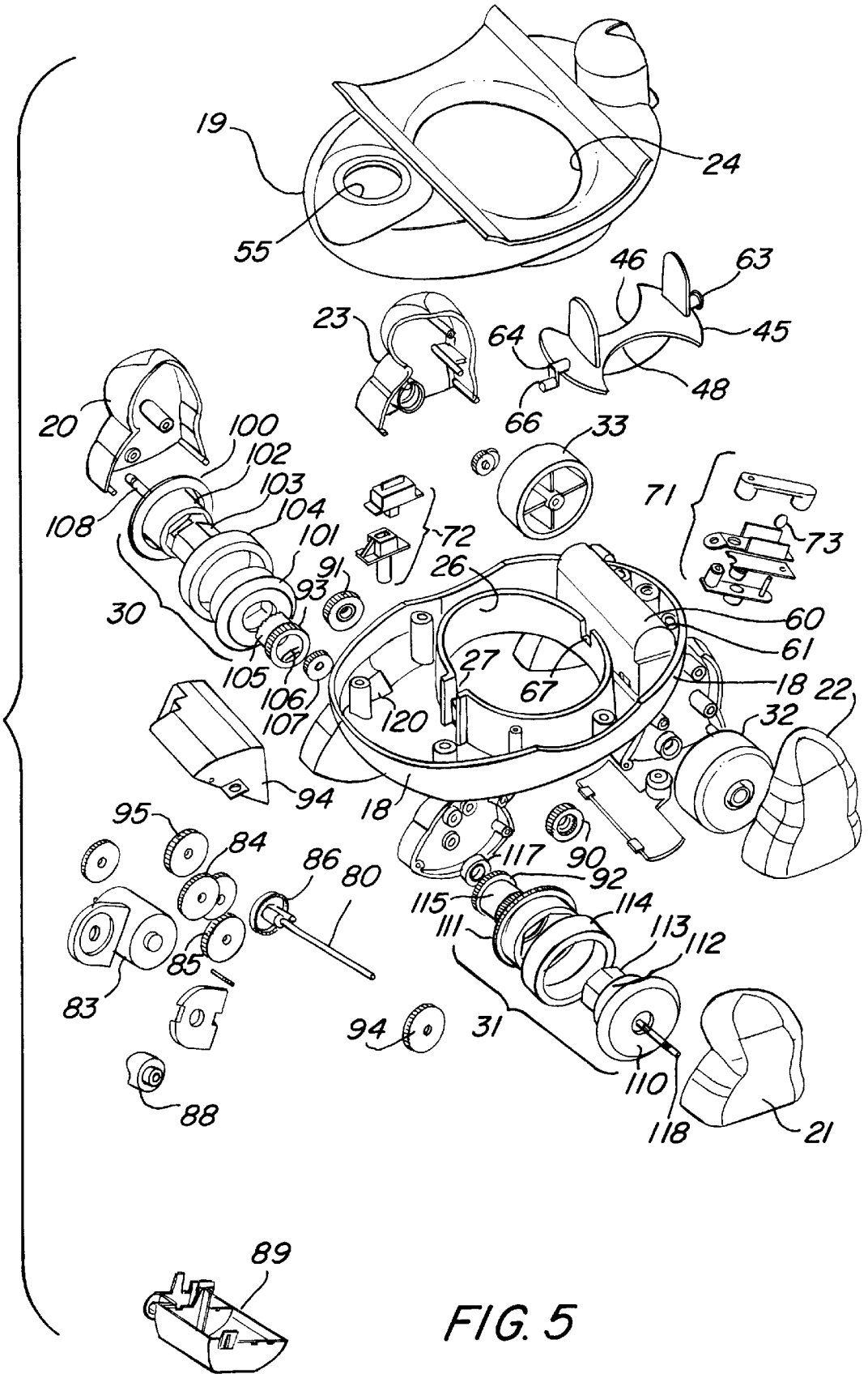
FIG. 5 sets forth a perspective assembly view of the present invention carrier.

Carrier 11 is preferably formed of a substantially rigid material such as molded plastic or the like and includes a body 35 supported by a plurality of wheel supports 20, 21, 22 and 23 (wheel support 23 seen in FIG. 3) each of which supports a respective rolling wheel 30, 31, 32 and 33 (seen in FIG. 5). A simulated horse head 25 is secured to body 35 to provide a pony riding theme for carrier 11. It will be apparent to those skilled in the art that the present invention described below in greater detail is independent of the aesthetic theme chosen for carrier 11. Thus, other animals or fanciful creations may be used to provide the aesthetics and general shape of carrier 11 without departing from the spirit and scope of the present invention. Carrier 11 further defines a cockpit 24 which, as is better seen in FIG. 2, supports a seat 45 therein. The support of plush FIG. 12 within cockpit 24 is described below in greater detail. However, suffice it to note here that as carrier 11 is driven forwardly in the direction indicated by arrow 26 under the impetus of an internal battery-powered drive mechanism (seen in FIG. 5), apparatus within carrier 11 seen in FIG. 4 causes seat 45 to pivot back and forth as illustrated by arrows 26. Thus, as carrier 11 drives forwardly, plush FIG. 12 is repeatedly pivoted from side to side within cockpit 24 as its supporting seat pivots.

In further accordance with the present invention, carrier 11 utilizes a battery-power motor drive combination which is operatively coupled to wheels 30 and 31 by means set forth below in greater detail. The propulsion provided through the rotation of wheels 30 and 31 moves carrier 11 forwardly which in turn moves body 13 forwardly. As mentioned above, seat 45 (seen in FIG. 2) pivots back and forth to impart side to side motion of plush FIG. 12 when carrier 11 is moving. The apparatus within carrier 11 imparting drive motion includes a battery power source (seen in FIG. 4) together with a gear drive mechanism and a motion-responsive switch which activates the drive motor within carrier 11 for a predetermined time interval. A conventional timer within the battery power source deactivates the drive motor following a predetermined interval of operation.

Thus, in the anticipated play pattern of the present invention, the child or infant user simply touches carrier 11 causing sufficient movement to activate the movement responsive switch therein and to couple power to front wheels 30 and 31 driving carrier 11 forwardly. As carrier 11 is driven forward following a touch or movement thereof, a standard timing circuit (not shown) is operative within the battery power supply to deactivate the motor drive following the termination of the predetermined interval. As a result, a play pattern develops in which the infant or very young child crawling across the floor touches toy 10 causing toy 10 to move away from the child for a brief time and a short distance and thereafter stopping. The child then pursues toy 10 once again touching the toy causing the toy to again move away from the child and then stop a small distance away. As is also mentioned above, plush FIG. 12 undergoes the side to side oscillatory motion described each time the power drive of toy 10 is operating.

Figure 2:
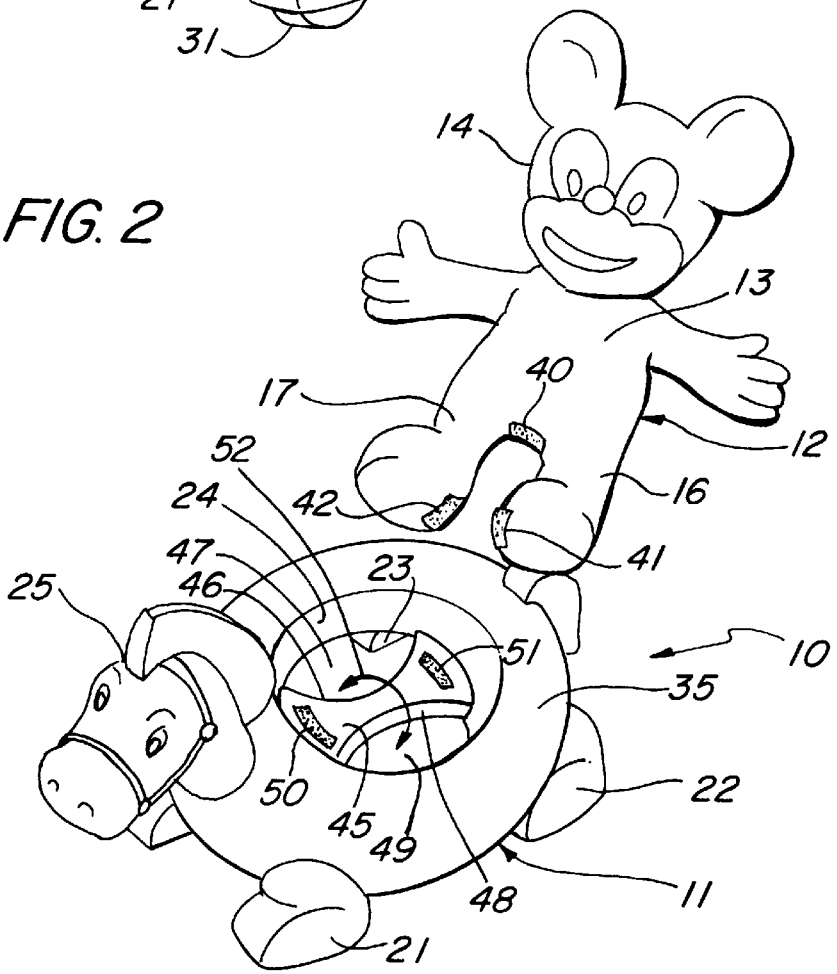
FIG. 2 sets forth a perspective assembly view of a touch-responsive self-powered carrier and plush figure constructed in accordance with the present invention.

FIG. 2 sets forth a top perspective view of the present invention toy illustrating the attachment of plush FIG. 12 to carrier 11. Carrier 11 includes a body 35 defining a cockpit 24 within which a multiply curved seat 45 is pivotally supported. Seat 45 is pivotable within cockpit 24 in the manner indicated by arrows 52. More specifically, seat 45 includes inwardly curved oppositely oriented edges 46 and 48 which combine with cockpit 24 to form leg openings 47 and 49 respectively on each side of seat 45. Further, seat 45 supports a pair of hook and loop fabric attachment pads 50 and 51.

Carrier 11 is supported by a plurality of wheel supports such as wheel supports 21 and 21 and includes a head 25 which, in the example of FIGS. 1 and 2, replicates a horse or pony's head.

In further accordance with the present invention, plush FIG. 12 includes a body 13 supporting a head 14 and a pair of downwardly extending legs 16 and 17. Legs 16 and 17 define aligned fabric attachment pads 41 and 42 which, in the preferred fabrication of the present invention, comprise hook and loop fastening pads. For example, pad 41 may be formed of a hook material while pad 42 is formed of a loop material. The opposite is equally applicable in which pad 41 supports loop material while pad 42 supports hook material. In further accordance with the present invention, a fabric attachment pad 40 is positioned on the seating area of body 13. Correspondingly, cooperating hook and loop fabric attachment pads 50 and 51 are selected to be able to engage fabric attachment pad 40.

In further accordance with the present invention, plush FIG. 12 is positioned within cockpit 24 by spreading legs 16 and 17 sufficiently to pass through openings 47 and 49 respectively. As legs 16 and 17 pass through openings 47 and 49, plush FIG. 12 becomes seated about seat 45 and is, in part, secured by the cooperation of fabric attachment pad 40 and pad 50 and/or pad 51. To complete the attachment of plush FIG. 12 to carrier 11, legs 16 and 17 are joined using fabric attachment pads 41 and 42 beneath seat 45 to provide secure attachment of plush FIG. 12.

As described above, apparatus within carrier 11 described below operates to drive carrier 11 for a short distance during which time seat 45 is caused to oscillate in the manner indicated by arrows 52 to produce a corresponding side to side motion of plush FIG. 12.

Figure 3:
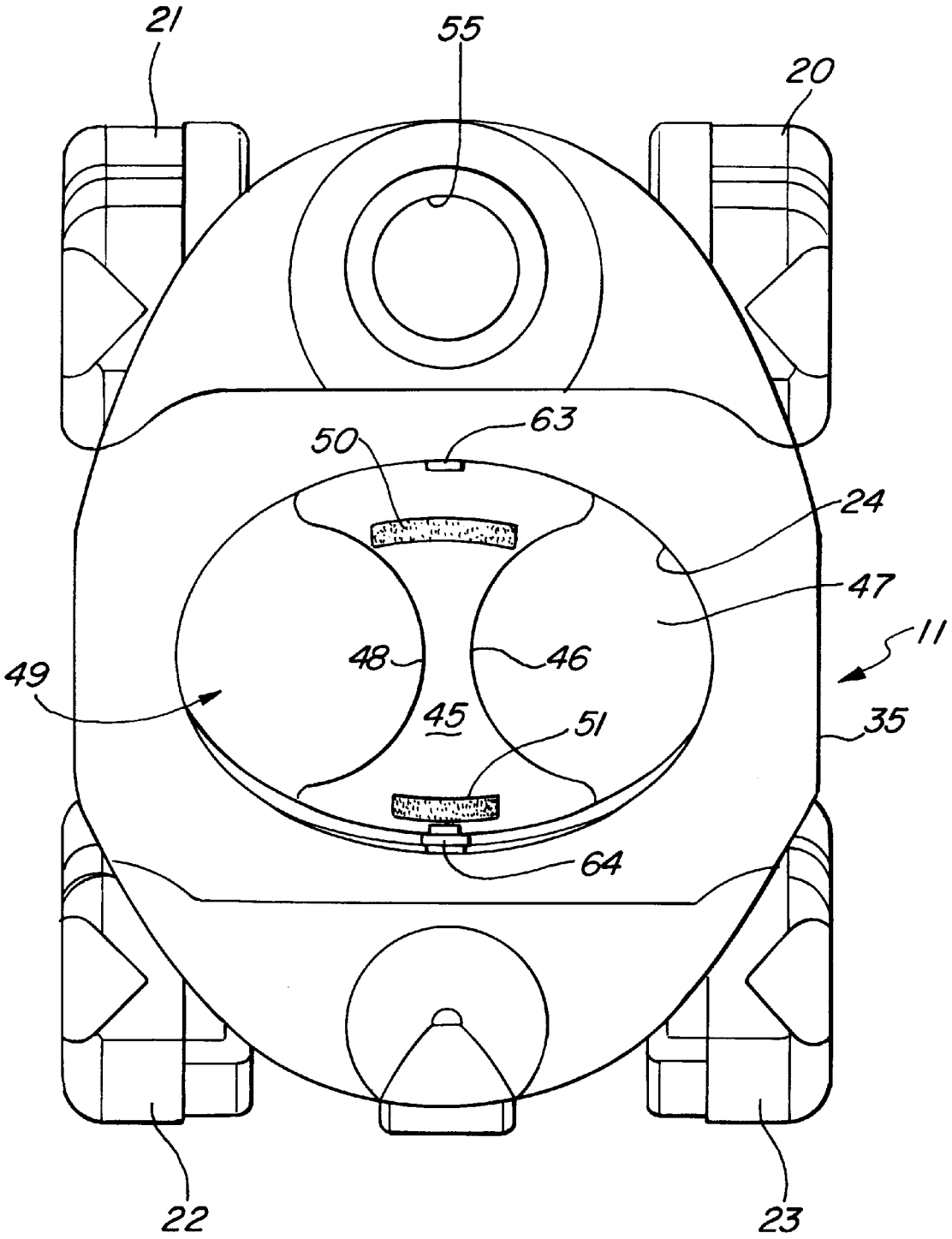
FIG. 3 sets forth a top view of the carrier of the present invention.

FIG. 3 sets forth a top plan view of carrier 11 having plush FIG. 12 removed therefrom. In addition, head 25 is removed to show head receptacle 55. Carrier 11 includes a body 35 preferably formed of a rigid material such as molded plastic or the like which is supported by a plurality of wheel supports 21, 22 and 23. A plurality of rolling wheels 30, 31,32 and 33 are rotationally supported within wheel supports 20 through 23 to facilitate moving carrier 11 across a space (wheels 30 through 33 seen in FIG. 5).

Within cockpit 24, a pivotable seat 45 defines inwardly curved edges 46 and 48 which combine with the interior wall of cockpit 24 to define respective openings 47 and 49. In further accordance with the present invention, the upper surface of seat 45 supports hook and loop fabric attachment pads 50 and 51 which, as described above in FIG. 2, cooperate with fabric attachment pad 40 of plush toy 12 to partially secure plush FIG. 12 within cockpit 24.

FIG. 4 sets forth a top perspective view of carrier 11 having upper portion 19 of carrier 11 (seen in FIG. 4) removed to show the operative structure within lower portion 18 of carrier 11. Thus, as mentioned above, carrier 11 is supported by a plurality of wheel supports 20, 21, 22 and 23 which in turn rotatably support a corresponding plurality of wheels 30, 31, 32 and 33 (wheel 33 seen in FIG. 4). Lower portion 18 of carrier 11 defines a lower cockpit wall 26 within which a seat 45 is pivotally secured by pivots 63 and 64. As described above, seat 45 defines a pair of inwardly curved edges 46 and 48 which together with wall 26 form openings 47 and 49 respectively through cockpit 24 (seen in FIG. 2). Seat 45 further supports a fabric attachment pad 51. The pivotal attachment of seat 45 to lower cockpit wall 26 at pivot 63 is a conventional post and receptacle combination (seen in FIG. 5). Pivot 64, however, is a more complex attachment in that a crank 66 extends downwardly from pivot 64 and engages a cam 88 supported by a shaft 80. Shaft 80 is supported between bearings 81 and 82 and is joined to a drive gear 86. Gear 86 is further coupled by gears 84 and 85 to a motor 83. In addition and as is better seen in FIG. 5, shaft 80 further supports a pair of gears 94 and 95 positioned within wheel supports 21 and 20 respectively.

Carrier 11 further supports a motion switch 71 and a battery pack 60. Battery pack 60 includes a plurality of conventional batteries coupled in accordance with conventional fabrication techniques to form a battery power source for operating motor 83. It will be understood that while the standard wiring used in coupling battery pack 20, motor 83, motion switch 71 and on/off switch 72 is not shown, such wiring is provided using conventional wiring techniques. Thus, battery pack 60 includes a conventional timer 61 operatively coupled to battery pack 60 to disable the connection to motor 83 following the expiration of a predetermined time interval. Timer 60 may be an electronic timer of the type typically used in low cost product production or may be provided by a simple bimetallic timer switch as desired. The important aspect of timer 61 is the interruption of power to motor 83 following a predetermined period of operation.

In operation, any touch or impact against carrier 11 sufficient to activate motion switch 71 causes battery pack 60 to couple power to motor 83 and initiates the operation of timer 61. With the activation of motor 83, rotational power is coupled by gears 84, 85 and 86 to shaft 80 producing rotation thereof. The rotation of shaft 80 also rotates cam 88 which includes high points displacing crank 66 in a pivotal movement as indicated by arrow 70. At the low points of cam 88 as it continues to rotate, crank 66 is able to move in the opposite direction of arrow 70 due to the weight of plush FIG. 12 (seen in FIG. 1). As a result, the rotation of cam 88 provides an oscillatory motion in which crank 66 swings back and forth over the high points of cam 88 causing seat 45 to undergo pivotal oscillation as described above.

While not seen in FIG. 4, it will be noted by temporary reference to FIG. 5 that a symmetrical set of drive mechanisms are operable within front wheel supports 30 and 31 to couple operative power to wheels 30 and 31.

Returning to FIG. 4, it will be noted that the outer portion of wheel support 21 has been removed to show wheel 31 supported upon gear 92. Gear 92 is further coupled by a gear 90 to a gear 94 supported at the end of shaft 80 (seen in FIG. 5). A corresponding gear coupling is operable on the opposite end of shaft 80 and, as is seen in FIG. 5, includes a gear 93 upon wheel 30 coupled to a gear 91 which in turn is coupled to shaft gear 95 on the end of shaft 80.

Thus, in operation, the disturbance or touching of carrier 11 activates motion switch 71 and, if on/off switch 72 is in the on position, initiates timer 61 and couples power to motor 83. Motor 83 in turn drives shaft 80 through gears 84, 85 and 86 to produce rotational power applied to wheels 30 and 31 and to oscillate crank 66 about pivot 64 to tilt seat 45 back and forth.

FIG. 5 sets forth a perspective assembly view of carrier 11. Carrier 11 is fabricated of an upper portion 19 and a lower portion 18 joined along their respective edges to form carrier 11 as shown in FIGS. 1 through 3. Upper portion 19 includes a cockpit 24 and a head receptacle 55. Receptacle 55 receives and supports head 25 in an attachment shown in FIGS. 1 and 2.

Lower portion 18 of carrier 11 includes a lower cockpit wall 26 defining a notch 67 and a slot 27 on the rearward and forward sides thereof. As described above, carrier 11 is supported by a plurality of wheel supports 20, 21, 22 and 23 which are joined to mating portions on the underside of lower portion 18. A pair of rear wheels 32 and 33 are rotatably secured to lower portion 18 within wheel supports 22 and 23 using conventional attachment posts (not shown). Wheel support 20 receives a multicomponent wheel 30 having a pair of hubs 100 and 101 together with a frictional tire 104 captivated therebetween. Hub 100 defines a socket 102 which receives a clutch plug 103. Tire 104 is received upon the outer surface of socket 102 while hub 101 is assembled to hub 100 to captivate frictional tire 104. A clutch member 105 defines a plurality of clutch teeth which face toward the interior of plug 103. Within plug 103, a plurality of corresponding clutch teeth (not shown) configured to cooperate with the teeth 105 are formed. Thus, into clutch 105 is assembled into hub 101 and plug 103, a clutch mechanism is provided. Clutch 105 supports a gear 93 which is coupled to a gear 91 rotatably supported upon lower portion 18. Additionally, a clutch spring 106 is received within clutch member 105 and secured by a spring retainer 107. The clutching action of clutch member 105 and plug 103 is provided when the force of spring 106 driving them together is overcome by a resisting force.

The combined structure of wheel 30 is rotatably secured upon lower portion 18 by a shaft 108 and covered by wheel support 20.

Wheel 31 is identical to wheel 30 and thus includes a pair of hubs 110 and 111 supported by a shaft 118 and having a clutch plug 113, a frictional tire 114 and a clutch member 115. While not seen in FIG. 5 due to the perspective view thereof, wheel 31 includes a clutch spring identical to clutch spring 106 received within clutch member 115. A spring retainer 117 secures the clutch spring in place. Once again, in similarity to wheel 30, the assembled structure of wheel 31 is rotatably supported beneath wheel support 21 upon lower portion 18 of carrier 11.

On/off switch 72 includes a conventional two-piece switch supported within lower portion 18. Motion switch 71 is conventional in fabrication and is operated by a rolling ball contact 73 in accordance with conventional fabrication techniques. Thus, motion switch 71 remains open-circuited in the absence of movement detected by the motion of ball 73 within the motion switch. When motion or impact is applied to lower portion 18 which is communicated to switch 71, ball 73 is disturbed rolling within the motion switch and making contact as a result.

A seat 45 having a pivot 63 received within notch 67 and a pivot 64 received within slot 27 is pivotally supported within lower cockpit wall 26 in the manner described above. As is also described above, seat 45 includes a crank 66 which extends forwardly beyond slot 27. A battery pack 60 and a timer unit 61 are supported at the rear of lower portion 18 and are fabricated in accordance with conventional fabrication techniques.

An electric motor 83 is supported within a housing 89 and a cover 94 which in turn are secured within lower portion 18. A shaft 80 extends transversely as shown in FIG. 4 above wheel supports 20 and 21 and supports an intermediate gear 86 together with end gears 94 and 95. Gears 94 and 95 pass through apertures formed in lower portion 18 to engage gears 90 and 91 respectively. In the perspective view of FIG. 5, aperture 120 which facilitate the engagement of gear 95 with gear 91 is shown. It will be understood that a corresponding aperture not seen in FIG. 5 is formed on the remaining side of lower portion 18 to allow coupling of gear 94 to gear 90. Gears 90 and 91 engage gears 92 and 93 respectively of clutch members 115 and 105. Motor 83 is conventional in fabrication and is operatively coupled to gear 86 of shaft 80 by a plurality of gears including gears 84 and 85. A cam 88 is secured to shaft 80 in the manner shown in FIG. 4 and rotates therewith. The rotation of shaft 80 under the power of motor 83 couples power simultaneously to wheels 30 and 31 while also rotating cam 88 against crank 66 of seat 45. As a result, the present invention carrier is driven forwardly for a predetermined time interval of travel during which time seat 45 and plush FIG. 12 (seen in FIG. 1) is pivotally oscillated.

It will be apparent to those skilled in the art that the great majority of components of the present invention may be fabricated using low cost, high volume, mass production molded plastic material in relatively simple fabrication.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. In combination with a toy figure and a self-propelled toy figure carrier, said combination comprising:

a toy figure having a body and a pair of legs;

a carrier having a body defining a cockpit and a plurality of supporting wheels;

a seat pivotably supported within said cockpit for receiving said toy figure;

drive means within said carrier coupled to at least one of said wheels for propelling said carrier;

a motion sensor initiating activation of said drive means in response to disturbance sufficient to activate the sensor; and timing means, responsive to said motion sensor, for timing an operational interval for said drive means and thereafter interrupting drive means operation.

2. The combination set forth in claim 1 wherein said drive means includes a seat pivoting mechanism coupled to said seat for rocking said seat during the operative interval of said drive means.

3. The combination set forth in claim 2 wherein said seat includes a crank and wherein said seat pivoting mechanism includes a cam rotated by said drive means and moving said crank.

4. The combination set forth in claim 3 wherein said seat defines a pair of inwardly curved side edges defining a narrow center and wherein said toy figure is seated in said cockpit by extending each leg of said pair of legs on each side of said seat.

5. The combination set forth in claim 4 wherein said legs include first and second cooperating fabric attachment pads joining said legs beneath said seat.

6. The combination set forth in claim 5 wherein said body supports a third attachment pad and wherein said seat supports a fourth attachment pad, said third and fourth attachment pads joining to secure said toy figure to said seat.

7. The combination set forth in claim 4 wherein said body supports a first attachment pad and wherein said seat supports a second attachment pad, said first and second attachment pads joining to secure said toy figure to said seat.

8. The combination set forth in claim 1 wherein said seat defines a pair of inwardly curved side edges defining a narrow center and wherein said toy figure is seated in said cockpit by extending each leg of said pair of legs on each side of said seat.

9. The combination set forth in claim 8 wherein said legs include first and second cooperating fabric attachment pads joining said legs beneath said seat.

10. The combination set forth in claim 9 wherein said body supports a third attachment pad and wherein said seat supports a fourth attachment pad, said third and fourth attachment pads joining to secure said toy figure to said seat.

11. The combination set forth in claim 1 wherein said toy figure is a soft-bodied plush figure.

* * * * *